US011147359B1

(12) United States Patent
Treadwell

(10) Patent No.: US 11,147,359 B1
(45) Date of Patent: Oct. 19, 2021

(54) DEVICE CARRIER

(71) Applicant: Apple Inc., Cupertino, CA (US)

(72) Inventor: Nicholas A. Treadwell, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/838,915

(22) Filed: Apr. 2, 2020

(51) Int. Cl.
*F16B 45/02* (2006.01)
*A45F 5/00* (2006.01)

(52) U.S. Cl.
CPC ..... *A45F 5/00* (2013.01)

(58) Field of Classification Search
CPC ..... Y10T 24/45408; Y10T 24/45414; Y10T 24/45419; Y10T 24/45429; Y10T 24/45424; F16B 45/02; A45F 2200/0516; A45F 5/02; A45F 2200/0508
USPC ..... 224/251, 217; 24/600.9, 601.1, 601.2, 24/601.3, 601.4
See application file for complete search history.

(56) References Cited

U.S. PATENT DOCUMENTS 5,913,479 A * 6/1999 Westwood, III ..... F16B 45/02 24/298
6,000,108 A * 12/1999 Roan ..... B66C 1/36 24/265 H
7,152,279 B2 12/2006 Elliott
7,286,803 B2 * 10/2007 Hamasaki ..... A45F 5/00 224/217
7,841,571 B1 * 11/2010 Ghormley ..... F16L 3/085 248/317
7,946,005 B2 * 5/2011 Lee ..... F16B 45/02 24/582.11
9,797,432 B2 * 10/2017 Inkavesvaanit ..... F16B 45/02
2005/0067444 A1 * 3/2005 Whitby ..... A47G 25/32 223/85
2005/0246874 A1 11/2005 Hsu
2016/0255918 A1 * 9/2016 Grossman ..... F16B 45/02
2017/0307004 A1 * 10/2017 Cardella ..... E05B 15/102
2019/0269231 A1 * 9/2019 Christian ..... A45C 11/00

FOREIGN PATENT DOCUMENTS

EP 1229258 B1 7/2005

* cited by examiner

*Primary Examiner* — Adam J Waggenspack
(74) *Attorney, Agent, or Firm* — Morgan, Lewis & Bockius LLP

(57) ABSTRACT

Device carriers described herein can support a device therein and enable a user to readily attach, detach, and exchange the device with other objects and/or to a user for easy access. The construction can include both rigid and flexible parts that are formed together to both facilitate easy operation and be resistant to wear. The construction can further provide an elegant appearance.

18 Claims, 4 Drawing Sheets

DEVICE CARRIER

TECHNICAL FIELD

The present description relates generally to device carriers, and, more particularly, to device carriers of monolithic parts integrally formed together.

BACKGROUND

Rings, frames, loops, and other carriers for holding objects together find ubiquitous use. Carriers, such as carabiners, have become integrated into everyday use as a convenient method of holding key rings, various tools, and other objects, due to the ease and speed with which objects can be attached and removed from the device coupled with the additional function of being quickly and easily attached to or detached from a user's belt loop, a bag strap, or other article, thus providing a convenient way to carry objects.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

It can be desirable to carry certain items for regular use while also providing an ability to couple such items to yet other objects and/or to a user for easy access. For example, a carabiner-type carrier can form a ring shape with a rigid frame and a moveable gate that interlock together to form the loop shape that continuously encloses an inner region in the closed configuration.

It would be advantageous to provide a carrier with a capability to secure hold a device while simultaneously providing a mechanism for easily attaching the carrier to other items. Such items can include key rings, loops on clothing, and other articles while securely retaining any device supported by the carrier.

It can also be advantageous to provide the carrier in a form that is resistant to wear. Given that an item supported by the carrier may be frequently used, the carrier can have a construction that is resistant to wear during active use and transport of the carrier. The carrier can also have a construction that facilitates exchange of carried and/or coupled items so that a user can easily attach, detach, and/or exchange items without causing harm to the carrier.

It can also be advantageous to provide the carrier in a form that is aesthetically pleasing. While some carriers, such as carabiners, as of a sturdy construction, they often feature bulky metal components, hinges, and other assembled parts that may have an unpleasing appearance.

Device carriers described herein can enable a user to readily attach, detach, and exchange a device with other objects and/or to a user for easy access. The construction can include both rigid and flexible parts that are formed together to both facilitate easy operation and be resistant to wear. The construction can further provide an elegant appearance.

These and other embodiments are discussed below with reference to FIGS. 1-7. However, those skilled in the art will readily appreciate that the detailed description given herein with respect to these Figures is for explanatory purposes only and should not be construed as limiting.

Figure 1:
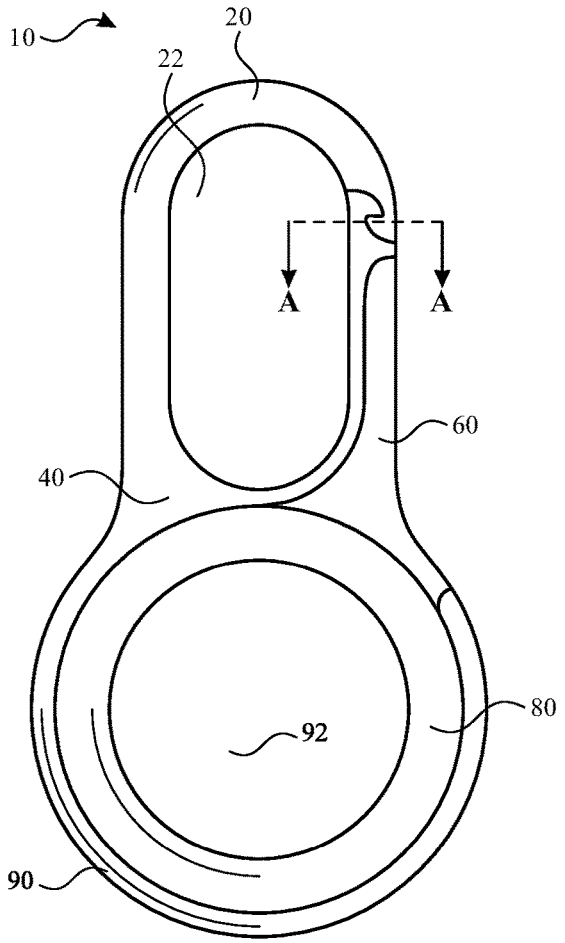
FIG. 1 illustrates a front view of a device carrier in a closed configuration, according to some embodiments of the present disclosure.

Referring now to FIG. 1, a device carrier can be provided with an ability to support a device as well as an ability to attach to other objects. As shown in FIG. 1, a device carrier 10 can include at least two sections. For example, the device carrier 10 can include an upper loop 20 having a gate for attaching and detaching the device carrier 10 to another object. The device carrier 10 can further include a lower loop 90 for supporting a device.

The lower loop 90 can be provided to carry, attach to, couple to, or otherwise support a device. For example, the lower loop 90 can form an opening 92 that extends partially or entirely through the device carrier 10. It will be understood that a variety of devices can be supported at the lower loop 90. For example, a device can be provided within the opening 92 of the lower loop for secure mounting thereto. The opening 92 can be designed with a shape and/or size that matches a shape and/or size of the device for effective securement. For example, when secured to the lower loop 90, the secured device can optionally be maintained with a fixed orientation and/or position with respect to the device carrier 10.

In some embodiments, the lower loop 90 is configured to support electronic devices, such as a key fob, security token, authentication device, wireless communication device, and the like. For example, the device supported by the lower loop 90 can include hardware with built-in authentication to control and secure access to other devices, computer systems, network services and data. The device can be used for identification and/or authentication to grant access to systems. As such, it may be desirable to keep the device in a location that is readily accessible by a user. Additionally, it can be desirable to allow the device to wirelessly communicate with other systems.

It will be understood that a variety of devices can be supported by the lower loop 90. Examples of such devices can be electronic devices that are operable by a user. For example, devices can include, input devices, remote controls, keyless entry devices, and the like. Further examples of such devices include Bluetooth devices, NFC devices, RFID devices (e.g., tags), and the like. The lower loop 90 can both secure the device and provide communication access to other devices.

It will be understood that the devices need not be electronic devices. For example, such devices can provide decorative or aesthetic features. Examples of such devices include pendants, jewelry, medallions, stones, and the like. The lower loop 90 can both secure and display the device.

While the opening 92 of the lower loop 90 is shown as being round, it will be understood that any size or shape can be provided to effectively support a device. For example, an inner periphery of the lower loop 90 can match an outer periphery of the device to be supported in the opening 92. Accordingly, the opening 92 of the lower loop 90 can be any size and/or shape to facilitate secure support of a device therein. Such shapes include round, oval, rectangular, square, triangular, polygonal, and the like.

It will be understood that while the lower loop 90 is shown as a closed loop, the lower loop 90 can alternatively be an open or openable loop. It will be further understood that a device supported in the opening 92 of the lower loop 90 can be tightly or loosely supported. For example, a device can extend through the opening 92 of the lower loop 90. Such devices can include a ring, clip, chain, chain link, and the like. As such, a portion of such a device can extend out of and away from the opening 92, yet remain supported by a secure linkage to the lower loop 90.

Figure 2:
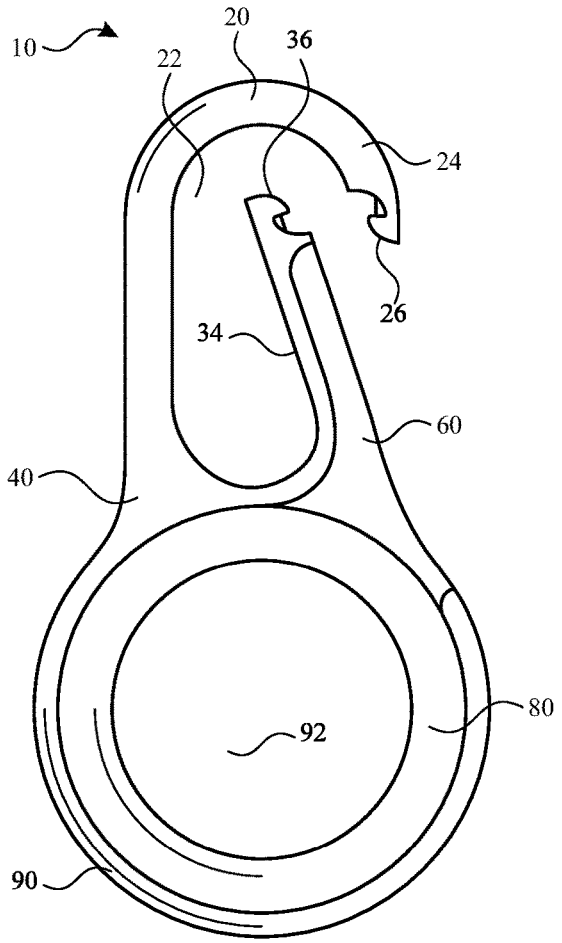
FIG. 2 illustrates a front view of the device carrier of FIG. 1 in an open configuration, according to some embodiments of the present disclosure.

Referring now to FIGS. 1 and 2, the device carrier 10 can include the upper loop 20 to releasably secure the device carrier 10 to other objects. For example, the upper loop 20 can include a frame 24 and a gate 34 that is moveable between a closed configuration (FIG. 1) and an open configuration (FIG. 2). Accordingly, the upper loop 20 can form an upper opening 22 that is open or closed depending on the configuration of the gate 34 with respect to the frame 24. The upper opening 22 can extend partially or entirely through the device carrier 10.

The frame 24 and the gate 34 can together form the upper loop 20 and the upper opening 22 thereof. It will be understood that the upper loop 20 can be coupled to a variety of objects. For example, the upper loop 20 can be coupled to clothing, a belt loop, a bag strap, a wallet, a key, a key chain, a ring, a clip, and the like. As such, a portion of the selected object can extend out of and away from the upper opening 22, yet remain coupled to the upper loop 20. The object can be coupled by passing at least a portion thereof past the gate 34 while in an open configuration. Thereafter, the gate 34 can be closed to secure the object to the upper loop 20 with a portion thereof within the upper opening 22. It will be further understood that an object coupled to the upper loop 20 can be tightly or loosely coupled. For example, when coupled to the upper loop 20, the coupled object can move to change its orientation and/or position with respect to the device carrier 10 while remaining coupled thereto. Additionally or alternatively, multiple objects can be coupled to the upper loop 20.

The upper loop can be formed by separate bodies that are joined together to provide the desired rigidity and flexibility for operation of the device carrier. For example, as shown in FIGS. 1 and 2, the upper loop 20 can be formed, in part, by a first body 40. The first body 40 can form at least a portion of the frame 24. In some embodiments, the first body 40 alone forms an entirety of the frame 24. The first body 40 can extend along an entire inner periphery of the upper loop 20, such that the upper opening 22 is entirely defined by the first body 40. The first body 40 can also form at least a portion of the gate 34. For example, the first body 40 can form an inner side of the gate 34.

By further example, as shown in FIGS. 1 and 2, the upper loop 20 can be formed, in part, by a second body 60. The second body 60 can form at least a portion of the gate 34. For example, the second body 60 can form an outer side of the gate 34, adjacent to the inner side formed by the first body 40.

The thickness of the first body 40 at the inner side of the gate 34 can be less than a thickness of the first body 40 along the frame 24. However, a combined thickness of the first body 40 at the inner side of the gate 34 and the second body 60 at the outer side of the gate 34 can be equal to a thickness of the first body 40 along the frame 24. Such a configuration allows the gate 34 and the frame 24 to appear as a continuous structure while in the closed configurations. It will be understood that other configurations and relative thicknesses are contemplated.

The first body 40 and the second body 60 can be of different materials. For example, the second body 60 can be of a material that is more elastic (i.e., lower modulus of elasticity) than the material of the first body 40. By further example, the first body 40 can be of a material that is more elastic (i.e., higher modulus of elasticity) than the material of the second body 60. As such, the first body 40 can be more rigid or stiff than the second body 60, and the second body 60 can be more flexible or pliable than the first body 40 based on the material and/or arrangement of the respective parts.

The frame 24 can be substantially stiff while the gate 34 is more flexible to facilitate movement of the gate 34 relative to the frame 24. For example, as described herein, the frame 24 can be formed by the first body 40 of a less elastic material. In contrast, the gate 34 can be formed by both a thin portion of the first body 40 and the second body 60 of a more elastic material. The resulting gate 34 can be more flexible or pliable than the frame 24. Accordingly, the gate 34 is allowed to pivot with respect to the frame 24 between the open configuration and the closed configuration. Moreover, the gate 34 can be biased to the closed configuration so that the absence of an external force allows the gate 34 to move toward and against the frame 24.

The lower loop 90 can be formed by the first body 40 extending along a first portion of an outer periphery of the lower loop 90 and the second body 60 extending along a second portion of the outer periphery of the lower loop 90. Each of the first body 40 and the second body 60 can be a continuous structure that extends to form portions of both the upper loop 20 and the lower loop 90.

The entire length of the second body 60 can facilitate movement of the gate 34. For example, the portion of the second body 60 that extends into the lower loop 90 can flex and stretch to facilitate movement of the gate 34 from the closed configuration to the open configuration. Furthermore, the second body 60 separates portions of the first body 40 from each other at a region of the pivot of the gate 34. By extending the second body 60 to such a length and separating portions of the first body 40, the pivot point is lower and the flexing and/or stretching is distributed across a greater region than would be possible if the first body 40 were formed as a closed loop in the lower loop 90. As such, the movement of the gate 34 is made easier with less risk of plastic deformation of the first body 40. Instead, the parts that provide elastic deformation perform movements, thereby allowing deformations to occur without causing undue stress and wear to the parts.

The lower loop 90 can further be formed by a third body 80 defining an inner periphery of the lower loop 90. While an entire outer periphery of the lower loop 90 can optionally be formed by the first body 40 and the second body 60, the third body can optionally define an entire inner periphery of the lower loop 90 and the opening 92.

The third body 80 can define a portion that directly engages a device to be carried by the device carrier 10. The third body 80 can be of a material that is more elastic (i.e., lower modulus of elasticity) than the material of the first body 40. By further example, the first body 40 can be of a material that is more elastic (i.e., higher modulus of elasticity) than the material of the third body 80. As such, the first body 40 can be more rigid or stiff than the third body 80, and the third body 80 can be more flexible or pliable than the first body 40 based on the material and/or arrangement of the respective parts.

In some embodiments, the first body 40, the second body 60, and/or the third body 80 are of different materials. Such materials can include plastic, rubber, polymers, elastics, other flexible materials, and/or combinations thereof. Such materials can be molded or otherwise shaped to form the respective bodies. The first body 40 can optionally include more rigid materials, such as metal. It will be understood that materials can be selected so that a range of motion of the gate 34 is permitted without plastic deformation of the first body 40 or the second body 60. In some embodiments, the second body 60 and/or the third body 80 are of the same material.

The first body 40, the second body 60, and/or the third body 80 can each be a separate monolithic structure, rather than an assembly of parts. As used herein, a monolithic structure is one that is integrally formed of a single piece of material, rather than of separate pieces that are joined together by an interface. For example, first body 40, the second body 60, and/or the third body 80 can each be a separate unibody and/or unitary structure. By providing a monolithic, unitary, and/or unibody body, the each of the bodies does not contain interfaces or discontinuities therein, such as those that occur in assembled parts. Accordingly, the monolithic, unitary, and/or unibody body can be fabricated to more precise and consistent dimensions and distribute forces along its length while flexing, bending, or stretching.

As shown in FIG. 2, the frame 24 can include a frame latch 26, and the gate 34 can include a gate latch 36. The frame latch 26 and the gate latch 36 can have complementary shapes, such that in a closed configuration, they matingly engage each other. Accordingly, in the closed configuration, the frame latch 26 and the gate latch 36 can limit movement of the gate 34 relative to the frame 24, other than the movement of pivoting toward and to the open configuration. Furthermore, while in the closed configuration, the frame latch 26 and the gate latch 36 can form an outer surface that is continuous (e.g., flush) with outer surfaces of both the frame 24 and the gate 34. The frame latch 26 and the gate latch 36 can both be formed by the first body 40. As such, the frame latch 26 and the gate latch 36 can be provided with sufficient rigidity to provide secure engagement while in the closed configuration.

Figure 3:
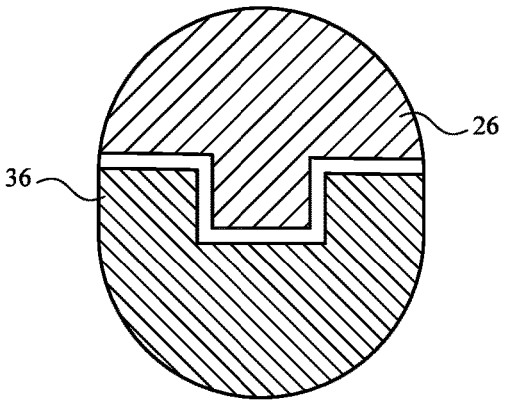
FIG. 3 illustrates a sectional view of the device carrier of FIG. 1 taken along line A-A, in accordance with some embodiments of the present disclosure.

Referring now to FIG. 3, the frame latch 26 and the gate latch 36 can further engage each other to limit other movements while in the closed configuration. For example, as shown in FIG. 3, each of the frame latch 26 and the gate latch 36 can include one or more teeth that matingly engage each other. While in the closed configuration, the teeth of the frame latch 26 and the gate latch 36 prevent the gate 34 from moving laterally (e.g., parallel to a pivot axis of the gate 34) with respect to the frame 24.

Figure 4:
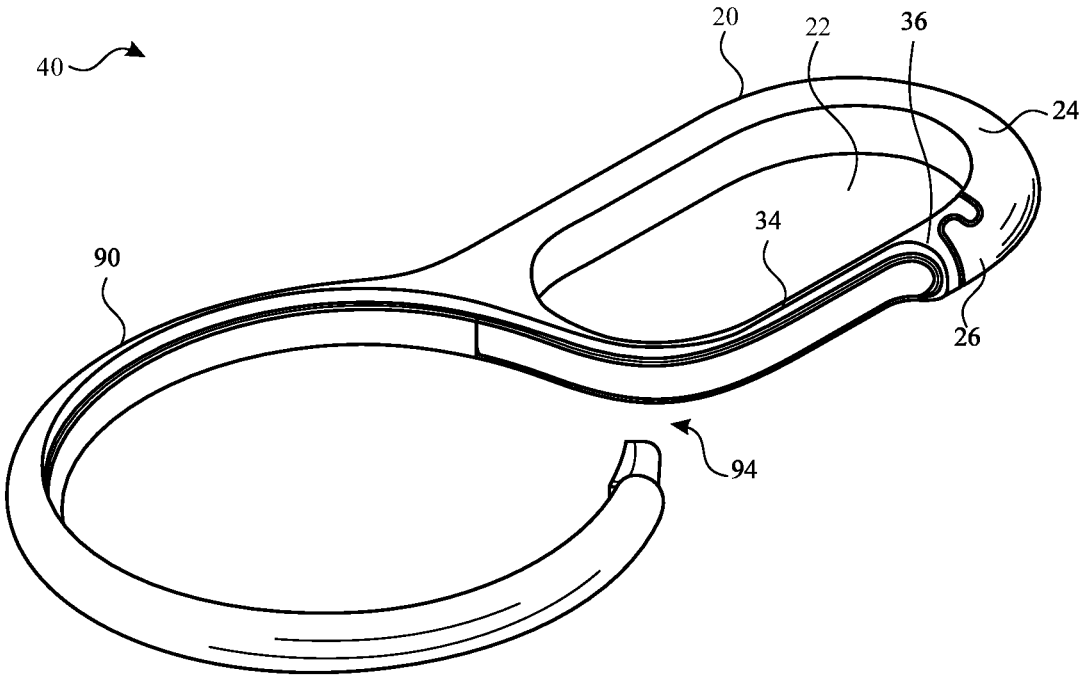
FIG. 4 illustrates a perspective view of a first body of a device carrier, according to some embodiments of the present disclosure.
Figure 5:
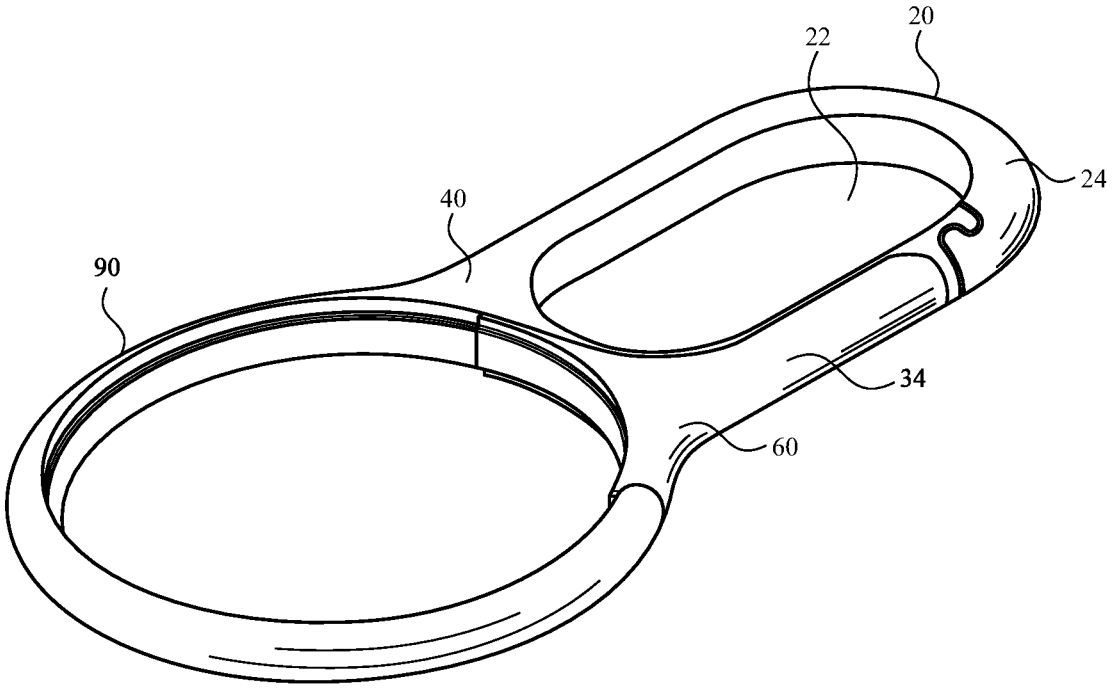
FIG. 5 illustrates a perspective view of a first body and a second body of a device carrier, according to some embodiments of the present disclosure.
Figure 6:
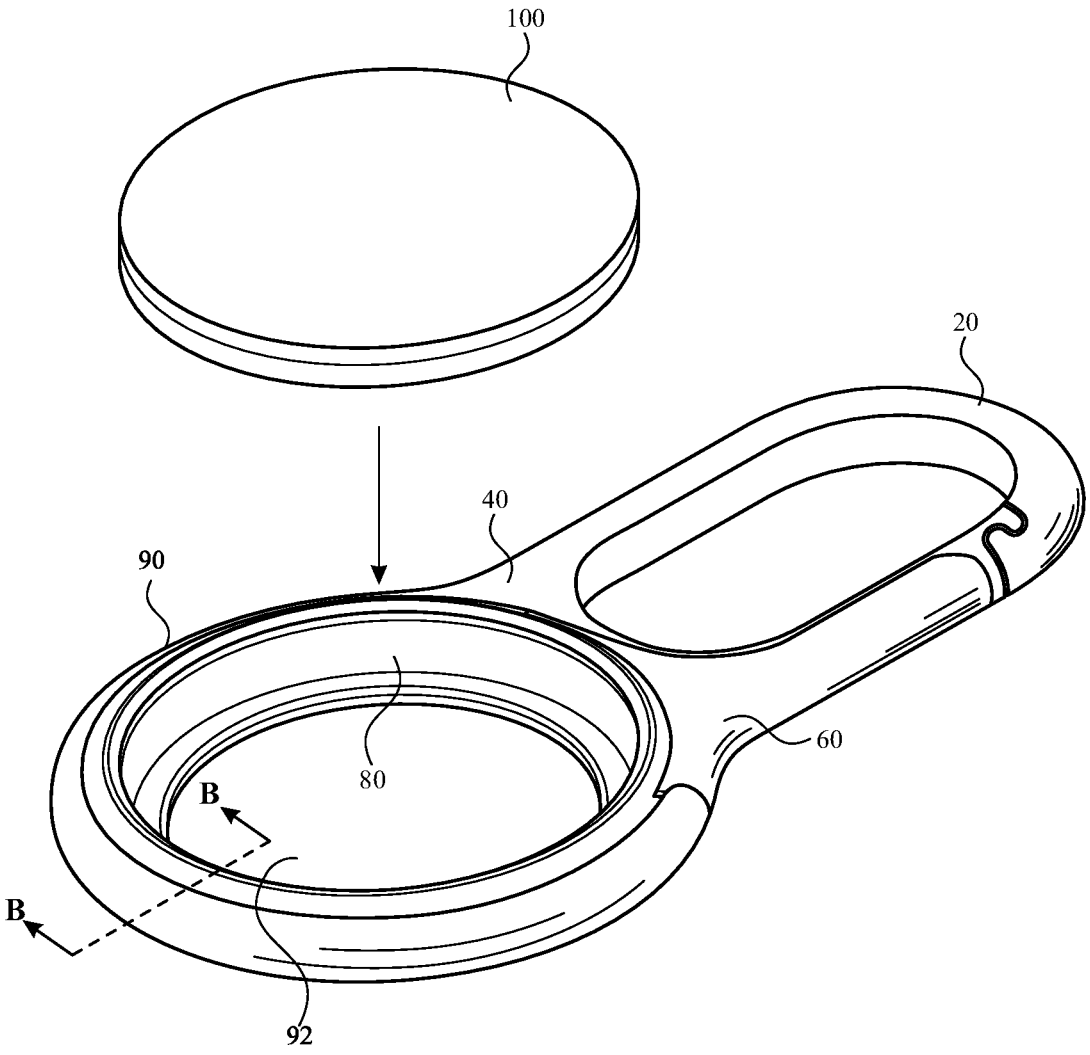
FIG. 6 illustrates a perspective view of a device carrier having a first body, a second body, and a third body, along with a device to be inserted into the third body, according to some embodiments of the present disclosure.

Referring now to FIGS. 4-6, the device carrier can be formed by a sequence of steps that provide each of the separate bodies. It will be understood that the process describe herein is merely an example, and that the device carrier can be formed with fewer or a greater number of steps, as well as with steps in a different order and/or performed simultaneously.

As shown in FIG. 4, the first body 40 can be provided with portions that form parts of the upper loop 20 and the lower loop 90. For example, the first body 40 can form some or the entire frame 24 and at least some of the gate 34 of the upper loop 20. By further example, the first body 40 can form at least some of the lower loop 90. At the lower loop 90, the first body 40 can form a gap 94 that separates an end of the first body 40 from a portion of the first body 40 that forms the gate 34. The gap 94 can be filled by other components and provide greater bending capabilities to the gate 34. Alternatively, the first body 40 can optionally form a closed loop by omitting the gap 94.

The first body 40 can be formed by molding or another process. As described herein, the first body 40 can be formed as a single, continuous monolithic piece without interfaces between separate parts.

As shown in FIG. 5, the second body 60 can be provided with portions that form parts of the upper loop 20 and the lower loop 90. For example, the second body 60 can form at least some of the gate 34 of the upper loop 20. By further example, the second body 60 can form at least some of the lower loop 90. At the lower loop 90, the second body 60 can fill the gap that separated the end of the first body 40 from a portion of the first body 40 that forms the gate 34. The second body 60 can provide greater bending capabilities to the gate 34 than would be provided with the first body 40 forming a closed loop.

The second body 60 can be formed by molding or another process. For example, the second body 60 can be molded against and/or over portions of the first body 40 in a second shot molding. As described herein, the second body 60 can be formed as a single, continuous monolithic piece without interfaces between separate parts. The first body 40 and the second body 60 can form outer surfaces that are continuous (e.g., flush) with each other. The outer surface can optionally omit seams or other discontinuities that would otherwise allow the separate bodies to be distinguishable. Furthermore, the first body 40 and the second body 60 can have a similar color and/or surface features (e.g., texture, smoothness, etc.) to give the appearance of being a continuous structure despite the different in materials and/or structural features.

As shown in FIG. 6, the third body 80 can be provided with portions that form parts of the lower loop 90. For example, the third body 80 can form at least an inner periphery of the lower loop 90. By further example, the third body 80 can define the lower opening 92 of the lower loop 90.

The third body 80 can be formed by molding or another process. For example, the third body 80 can be molded against and/or over portions of the first body 40 and/or the second body 60 in a third shot molding. As described herein, the third body 80 can be formed as a single, continuous monolithic piece without interfaces between separate parts. The third body 80 can form outer surfaces that are continuous (e.g., flush) with the first body 40 and/or the second body 60. The outer surface can optionally omit seams or other discontinuities that would otherwise allow the separate bodies to be distinguishable. Furthermore, the third body 80 can have a similar color and/or surface features (e.g., texture, smoothness, etc.) as the first body 40 and/or the second body 60 to give the appearance of being a continuous structure despite the different in materials and/or structural features.

Figure 7:
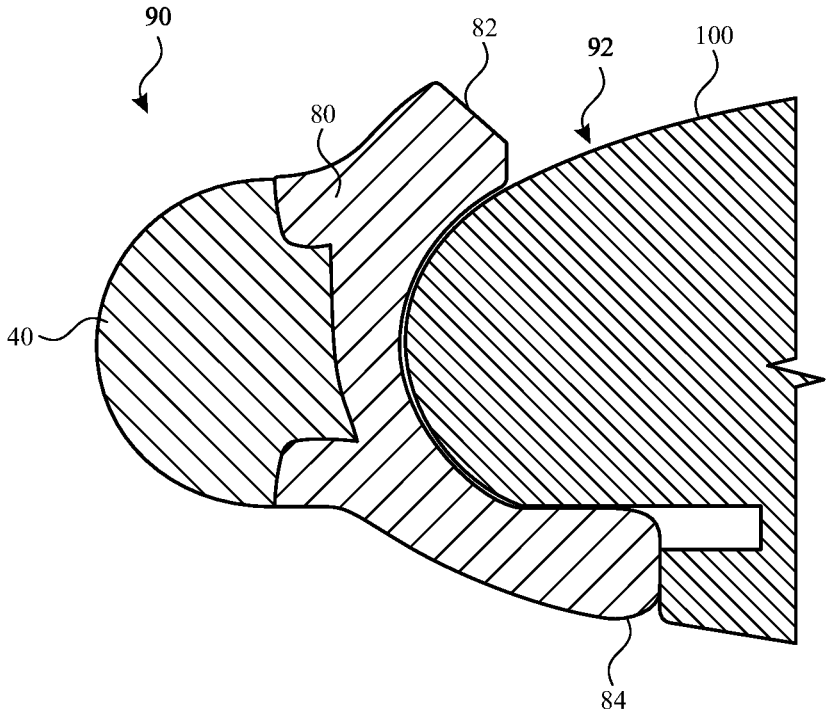
FIG. 7 illustrates a sectional view of the device carrier of FIG. 6 taken along line B-B, in accordance with some embodiments of the present disclosure.

Referring now to FIGS. 6 and 7, a device can be supported by the device carrier at the lower loop. As shown in FIG. 6, the device 100 can be inserted or otherwise attached to the lower loop 90 to be secured and supported within the opening 92. As shown in FIG. 7, the third body 80 can receive the device 100 within a cavity thereof. For example, the third body 80 can form a first ridge 82 and a second ridge 84 that define a space, including the lower opening 92. The device 100 can move into the opening 92 by deflecting at least one of the first ridge 82 and the second ridge 84, which can elastically deform to allow passage. The device 100 can be secured by extending at least partially into the space between the first ridge 82 and the second ridge 84. The device 100 can thereafter be removed from the opening 92 by applying a force that deflects at least one of the first ridge 82 and the second ridge 84. As shown in FIG. 7, the first ridge 82 and the second ridge 84 can have different features, so that insertion and removal of the device 100 is enabled on a preferred side of the lower loop 90. Alternatively, the first ridge 82 and the second ridge 84 can have similar features to provide greater symmetry.

Accordingly, an entirety of the device carrier 10 can be formed by the first body 40, the second body 60, and optionally the third body 80. Each of these bodies can be monolithically formed (e.g., by molding) and the separate bodies can be combined together (e.g., by co-molding). The assembled device can have the appearance and feel of an integrated device of a single continuous piece despite providing distinct bodies with different structural characteristics.

A carrier device described herein can support a device therein and enable a user to readily attach, detach, and exchange the device with other objects and/or to a user for easy access. The construction can include both rigid and flexible parts that are formed together to both facilitate easy operation and be resistant to wear. The construction can further provide an elegant appearance.

Various examples of aspects of the disclosure are described below as clauses for convenience. These are provided as examples, and do not limit the subject technology.

Clause A: a device carrier comprising: a upper loop being formed by: a first body extending along an entire inner periphery of the upper loop and defining an inner side of a gate configured to move between an open configuration and a closed configuration of the upper loop; and a second body defining an outer side of the gate, the second body being more flexible than the first body; a lower loop configured to secure a device and being formed by: the first body extending along a first portion of an outer periphery of the lower loop; and the second body extending along a second portion of the outer periphery of the lower loop.

Clause B: a device carrier comprising: a frame comprising a first material having a first rigidity; a gate being pivotable with respect to the frame, the gate comprising: the first material; and a second material having a second rigidity lower than the first rigidity; a lower loop comprising: the first material; and the second material, the second material in the lower loop connecting separate portions of the first material in the lower loop.

Clause C: a device carrier comprising: a first body forming: a frame; an inner side of a gate, the gate being pivotable with respect to the frame; and a first portion of a lower loop, the first body forming a gap between the first portion of a lower loop and the inner side of the gate; a second body forming: an outer side of the gate; and a second portion of the lower loop, the second portion filling the gap between the first portion of the lower loop and the inner side of the gate.

One or more of the above clauses can include one or more of the features described below. It is noted that any of the following clauses may be combined in any combination with each other, and placed into a respective independent clause, e.g., clause A, B, or C.

Clause 1: the first body is a first monolithic piece, and the second body is a second monolithic piece.

Clause 2: the lower loop is further formed by a third body defining an inner periphery of the lower loop, the third body being more flexible than the first body.

Clause 3: when the gate moves from the closed configuration to the open configuration, the second body elastically deforms.

Clause 4: the upper loop comprises a first latch and a second latch configured to engage the first latch in the closed configuration of the gate.

Clause 5: the first material is a first monolithic piece, and the second material is a second monolithic piece.

Clause 6: the lower loop further comprises a third material defining an inner periphery of the lower loop, the third material having a third rigidity lower than the first rigidity.

Clause 7: when the gate pivots with respect to the frame, the first material and the second material of the gate elastically deform.

Clause 8: the gate comprises a gate latch and the frame comprises a frame latch configured to engage the gate latch in a closed configuration of the gate.

Clause 9: a thickness of the first body at the inner side of the gate is less than a thickness of the first body along the frame.

Clause 10: a combined thickness of the first body at the inner side of the gate and the second body at the outer side of the gate is equal to a thickness of the first body along the frame.

Clause 11: a third body extending along an entire inner periphery of the lower loop.

Clause 12: the frame and the gate form an upper loop.

Clause 13: the first body extends along an entire inner periphery of the upper loop.

Clause 14: the first body is of a first material having a first rigidity, and the second body is of a second material having a second rigidity less than the first rigidity.

Clause 15: when the gate pivots with respect to the frame, the second body elastically deforms.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A device carrier comprising:

an upper loop being formed by:

a monolithic first body extending along an entire inner periphery of the upper loop and defining an inner side of a gate configured to move between an open configuration and a closed configuration of the upper loop; and a monolithic second body separate from the first body and defining an outer side of the gate, the second body being more flexible than the first body; and a lower loop configured to secure a device and being formed by:

the first body extending along a first portion of an outer periphery of the lower loop to surround only a first portion of an opening; and the second body extending along a second portion of the outer periphery of the lower loop to surround a second portion of the opening that is not surrounded by the first body.

2. The device carrier of claim 1, wherein the lower loop is further formed by a third body defining an inner periphery of the lower loop, the third body being more flexible than the first body.

3. The device carrier of claim 1, wherein, when the gate moves from the closed configuration to the open configuration, the second body elastically deforms.

4. The device carrier of claim 1, wherein the upper loop comprises a first latch and a second latch configured to engage the first latch in the closed configuration of the gate.

5. A device carrier comprising:

a frame having a frame portion of a first material having a first rigidity;

a gate being pivotable with respect to the frame, the gate comprising:

a first gate portion of the first material; and a second gate portion having a composition of a second material having a second rigidity lower than the first rigidity;

a lower loop comprising:

a first loop portion of the first material extending partially about an opening, and a second loop portion of the second material, the second loop portion connecting to separate different portions of the first material in the lower loop to span the portion of the opening not enclosed by the first material such that the first loop portion and the second loop portion form a complete loop about the opening.

6. The device carrier of claim 5, wherein the first material is a first monolithic piece, and the second material is a second monolithic piece.

7. The device carrier of claim 5, wherein the lower loop further comprises a third material defining an inner periphery of the lower loop, the third material having a third rigidity lower than the first rigidity.

8. The device carrier of claim 5, wherein, when the gate pivots with respect to the frame, the first material and the second material of the gate elastically deform.

9. The device carrier of claim 5, wherein the gate comprises a gate latch and the frame comprises a frame latch configured to engage the gate latch in a closed configuration of the gate.

10. A device carrier comprising:

a monolithic first body forming:

a frame, an inner side of a gate, the gate being pivotable with respect to the frame, and a first portion of a lower loop, the first body forming a gap between the first portion of a lower loop and the inner side of the gate; and a monolithic second body separate from the first body and forming:

an outer side of the gate, and a second portion of the lower loop, the second portion filling the gap between the first portion of the lower loop and the inner side of the gate.

11. The device carrier of claim 10, wherein a thickness of the first body at the inner side of the gate is less than a thickness of the first body along the frame.

12. The device carrier of claim 10, wherein a combined thickness of the first body at the inner side of the gate and the second body at the outer side of the gate is equal to a thickness of the first body along the frame.

13. The device carrier of claim 10, further comprising a third body extending along an entire inner periphery of the lower loop.

14. The device carrier of claim 10, wherein the frame and the gate form an upper loop.

15. The device carrier of claim 14, wherein the first body extends along an entire inner periphery of the upper loop.

16. The device carrier of claim 10, wherein the first body is of a first material having a first rigidity, and the second body is of a second material having a second rigidity less than the first rigidity.

17. The device carrier of claim 10, wherein, when the gate pivots with respect to the frame, the second body elastically deforms.

18. The device carrier of claim 10, wherein the gate comprises a gate latch and the frame comprises a frame latch configured to engage the gate latch in a closed configuration of the gate.

* * * * *